US009476663B2

(12) United States Patent
Selvetti

(10) Patent No.: US 9,476,663 B2
(45) Date of Patent: Oct. 25, 2016

(54) REMOVABLE BARREL AND HAND GUARD FOR MODULAR RIFLES

(71) Applicant: Mike Selvetti, Palm Bay, FL (US)

(72) Inventor: Mike Selvetti, Palm Bay, FL (US)

( * ) Notice: Subject to any disclaimer, the term of this patent is extended or adjusted under 35 U.S.C. 154(b) by 0 days.

(21) Appl. No.: 14/812,121

(22) Filed: Jul. 29, 2015

(65) Prior Publication Data

US 2016/0033225 A1 Feb. 4, 2016

Related U.S. Application Data

(60) Provisional application No. 62/030,260, filed on Jul. 29, 2014.

(51) Int. Cl.

| | |
|---|---|
| ***F41A 21/48*** | (2006.01) |
| ***F41A 11/02*** | (2006.01) |
| ***F41C 23/16*** | (2006.01) |

(52) U.S. Cl.

CPC ..... *F41A 21/482* (2013.01); *F41A 11/02* (2013.01); *F41A 21/484* (2013.01); *F41C 23/16* (2013.01)

(58) Field of Classification Search

USPC ..... 42/75.02

See application file for complete search history.

(56) References Cited

U.S. PATENT DOCUMENTS

| | | | | |
|---|---|---|---|---|
| 2,445,339 A * | 7/1948 | Summerbell | F41A 3/10 | 89/14.05 |
| 2,465,196 A * | 3/1949 | Browning | F41A 3/86 | 42/75.01 |
| 2,611,297 A * | 9/1952 | Simpson | F41A 21/484 | 42/75.02 |
| 2,809,457 A * | 10/1957 | Simpson | F41A 21/481 | 42/75.01 |
| 3,756,119 A * | 9/1973 | Curtis | F41A 3/72 | 42/25 |
| 4,388,773 A * | 6/1983 | Beretta | F41A 21/484 | 42/75.02 |
| 4,742,757 A * | 5/1988 | Matzagg | F41A 3/40 | 42/75.02 |
| 6,606,812 B1 * | 8/2003 | Gwinn, Jr. | F41A 21/484 | 42/75.02 |
| 6,671,990 B1 * | 1/2004 | Booth | F41C 23/16 | 42/75.01 |
| 7,313,883 B2 * | 1/2008 | Leitner-Wise | F41A 3/66 | 42/75.02 |

(Continued)

FOREIGN PATENT DOCUMENTS

FR 1362361 A * 5/1964 ..... F41A 21/484

OTHER PUBLICATIONS

Machine Translation of French Patent FR 1362361.*

*Primary Examiner* — Troy Chambers
*Assistant Examiner* — Joshua Semick
(74) *Attorney, Agent, or Firm* — John L. DeAngelis; Beusse Wolter Sanks & Maire, PLLC.

(57) ABSTRACT

A kit for use with a modular weapon having a barrel and having an upper receiver defining a gas port and a barrel opening. The kit comprises an upper receiver plate for attaching to the upper receiver, and a barrel plate. The weapon barrel passes though concentric openings in the upper receiver plate and the barrel plate and is secured in the opening within the barrel plate. Another opening in the barrel plate receives a primary gas tube such that a rearward segment of the primary gas tube extends rearwardly from that opening and a forward segment of the primary gas tube extends forwardly from that opening. A forward end of a gas tube extension couples to a rearward end of the primary gas tube and a rearward end of the gas tube extension is received within the gas port when the kit is in use with the modular rifle. An assembly removably attaches the upper receiver plate and the barrel plate thereby creating a gas flow path beginning at the gas port and comprising the gas tube extension, the rearward segment of the primary gas tube, and the forward segment of the primary gas tube.

19 Claims, 11 Drawing Sheets

(56) References Cited

U.S. PATENT DOCUMENTS 7,464,496 B1 * 12/2008 Davies ..... F41A 21/24 42/75.02
7,975,596 B2 * 7/2011 Darian ..... F41A 3/38 42/6
8,276,303 B2 * 10/2012 Kapusta ..... F41C 23/16 42/71.01
8,539,708 B2 * 9/2013 Kenney ..... F41A 21/485 42/75.01
8,726,559 B1 * 5/2014 Mueller ..... F41A 21/482 42/75.02
8,839,545 B1 * 9/2014 Gangl ..... F41A 11/00 42/75.03
8,863,426 B1 * 10/2014 Zinsner ..... F41C 23/16 42/71.01
9,057,576 B2 * 6/2015 Barrett ..... F41A 21/481
2015/0135572 A1 * 5/2015 Davies ..... F41C 23/16 42/71.01
2015/0369555 A1 * 12/2015 Daniel ..... F41A 21/48 42/75.02

* cited by examiner

REMOVABLE BARREL AND HAND GUARD FOR MODULAR RIFLES

CROSS REFERENCE TO RELATED APPLICATIONS

This patent application claims the benefit of U.S. provisional patent application filed on Jul. 29, 2014 and assigned Application No. 62/030,260, incorporated herein in its entirety.

FIELD OF THE INVENTION

A method, system, and kit related to a removable and replaceable barrel and gas tube for modular rifles.

BACKGROUND OF THE INVENTION

M16 and AR15 rifles are air-cooled, gas-operated, magazine-fed assault rifles. These rifles are the primary assault weapons used by military and police forces.

A gas-operated rifle uses a portion of the high pressure gas formed as the ammunition round travels through the barrel to supply energy to operate the auto-loading feature of the rifle. The high pressure gas powers a mechanism to extract the spent casing and chamber a new cartridge. Energy from the gas is harnessed through either a port in the barrel or a trap in the muzzle. This high-pressure gas travels through a gas tube that is located parallel to the barrel and upon exiting the tube impinges on a surface such as a piston head to provide motion for unlocking the action, extracting the spent casing, ejecting the spent casing, cocking the hammer or striker, chambering a fresh cartridge, and finally locking the action.

Such a modular rifle is illustrated in FIG. 1. As shown in FIG. 2, the rifle comprises a lower receiver assembly 1 conveniently separable from an upper receiver assembly 2. The lower and upper receiver assemblies 1 and 2 are connected using push pins with the pins carried by the lower receiver assembly 1 and extending through openings (not visible in FIG. 2) in the upper receiver assembly 2.

The lower receiver assembly 1 contains a lower receiver, fire control components, and a buffer assembly included in the butt-stock. These components are not separately designated in FIG. 2 and are not pertinent to the structure and function of the present invention. Instead, the present invention relates generally to the upper receiver assembly 2 and its components.

Prior art FIG. 3 illustrates the upper receiver assembly 2, comprising an upper receiver 3 and a hand guard 4 surrounding a barrel 5. The barrel 5 is affixed to the upper receiver 3 using a barrel nut that is obscured from view in FIG. 3 but shown in FIG. 4.

Prior art FIG. 4 illustrates the upper receiver assembly 2 with the hand guard 4 removed to expose a barrel nut 6, a stock gas tube 7 and a gas block 8 that holds the stock gas tube 7 in place. The barrel 5 and the gas block 8 each define a small opening through which gas passes from the barrel, through the gas block, and into the stock gas tube 7.

In the prior art modular rifles of FIGS. 1-4, the barrel 5 is affixed to the upper receiver 3 with the barrel nut 6 and this arrangement requires specialized tools and fixtures to remove and attach the barrel. For example, if the user wishes to change to a barrel of a different length. The prior art design makes it nearly impossible to remove the barrel in the field without use of these tools. Removal also requires a significant amount of time and familiarity with intricate mechanisms of the rifle.

BRIEF DESCRIPTION OF THE FIGURES

The forgoing and other features of the present invention will be apparent to one skilled in the art to which the present invention relates upon consideration of the description of the invention with reference to the accompanying drawings. The use of the same reference numeral in the various figures refers to the same element.

DETAILED DESCRIPTION OF THE INVENTION

Figure 1:
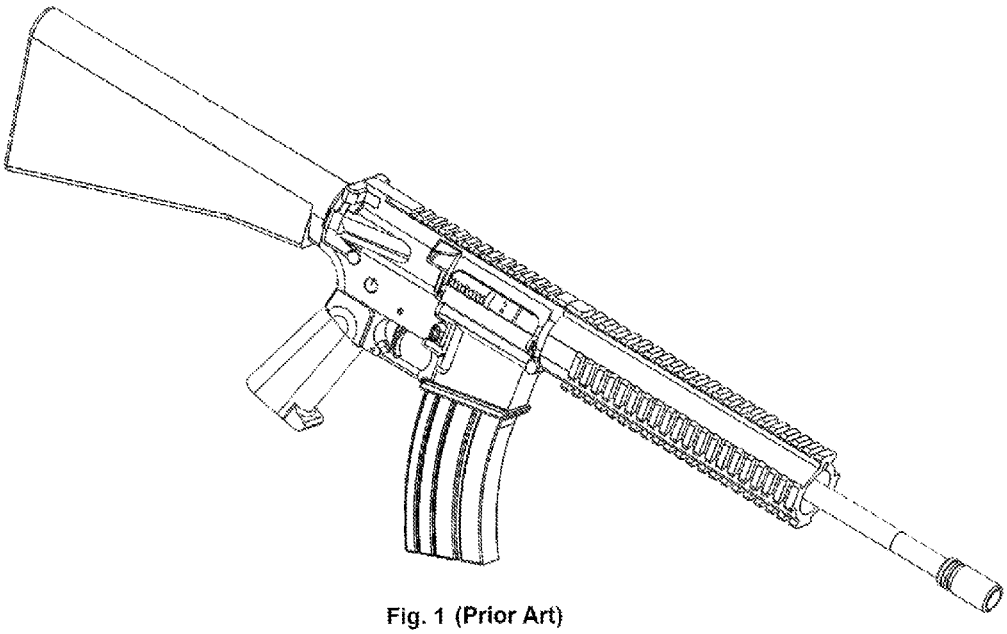
Fig. 1 (Prior Art)
FIG. 1 illustrates an exemplary prior art AR15/AR10 modular rifle.
Figure 2:
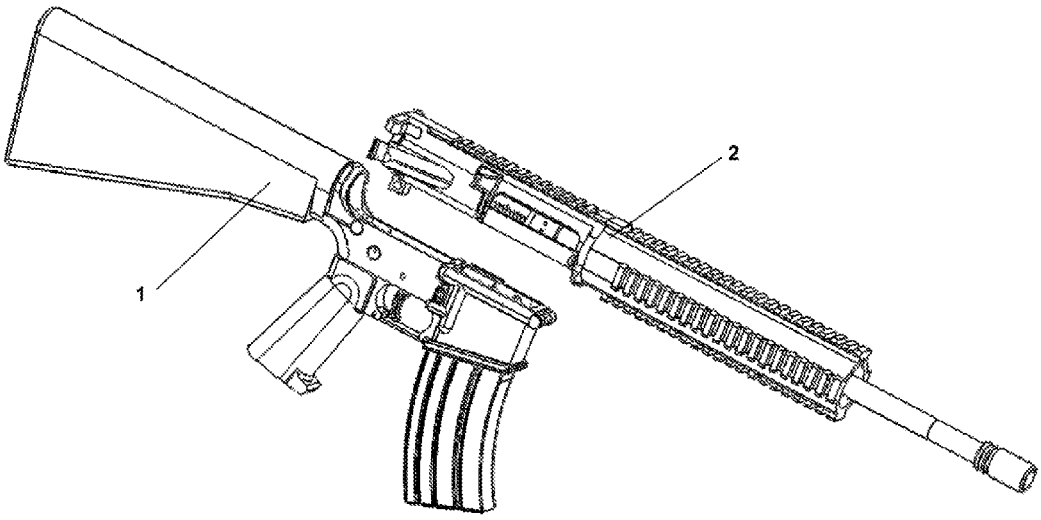
Fig. 2 (Prior Art)
FIG. 2 illustrates an exploded view of the prior art AR15/AR10 modular rifle of FIG. 1.
Figure 3:
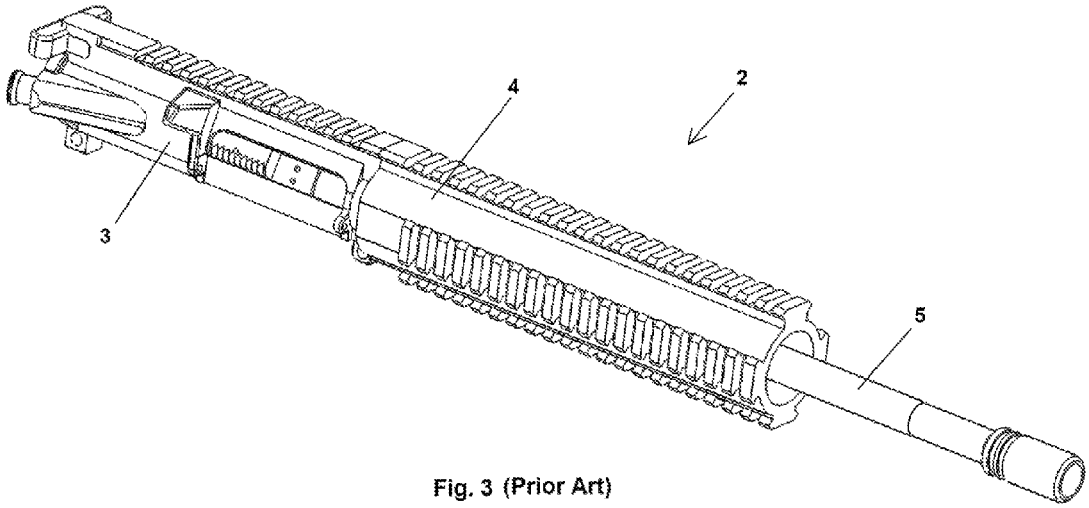
Fig. 3 (Prior Art)
FIGS. 3 and 4 illustrate components of the prior art upper receiver assembly of FIG. 2.
Figure 4:
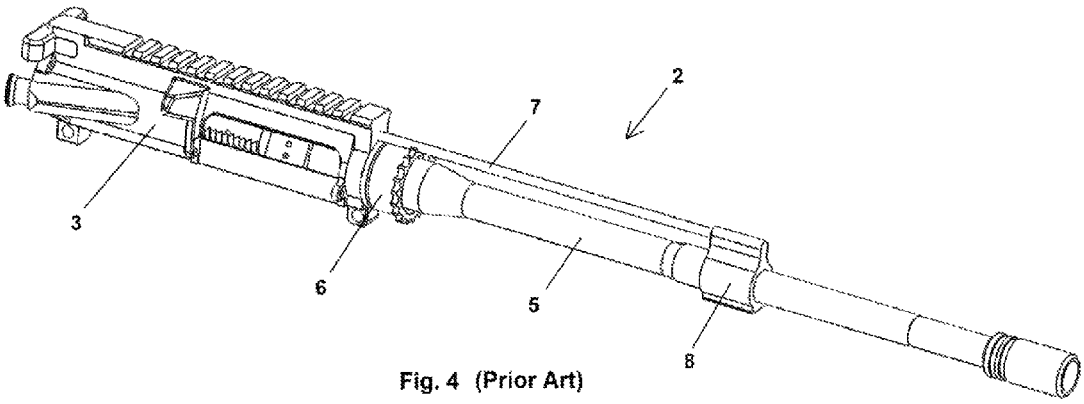
Fig. 4 (Prior Art)

Before describing in detail the particular methods and apparatuses related to a removable barrel and hand guard for modular rifles, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions.

The presented embodiments are not intended to define limits as to the structures, elements or methods of the inventions, but only to provide exemplary constructions. The embodiments are permissive rather than mandatory and illustrative rather than exhaustive.

The components of the present invention when installed in a rifle allow the rifle user to easily and quickly remove the barrel without specialized tools and replace the removed barrel with a barrel of a different length. As is known by those skilled in the art, a longer barrel allows the ammunition round to exit the barrel with a greater velocity and thus travel farther (i.e., have a longer range) than a round shot from a shorter barrel.

Advantages of the present invention include at least: allowing the rifle barrel to be easily removed to store or transport the rifle in a smaller space; allowing the user to easily remove and replace the barrel with a different length barrel; allowing conversion of the rifle to a different caliber; and, simplifying cleaning of the weapon as specialized tools are not required to disassemble the rifle. With regard to different barrel lengths, a sniper prefers a longer rifle barrel while a shorter barrel is desired in close quarter combat.

The invention also permits the user to use any one of many different available hand guards. Alternatively, the barrel coupler of the present invention may be supplied with a hand guard permanently integrated with the barrel coupler. In this latter embodiment the barrel and hand guard can both be removed from the rifle as one unit without the user of tools.

The components of the present invention may be installed on any rifle or weapon having an appropriately styled barrel and receiver interface.

The components of the invention may also be considered a kit for adding and/or replacing the components of an existing rifle to allow the user to then easily and conveniently exchange a barrel of a first length for a barrel of a second length. The kit components can be installed on an existing rifle without any permanent modifications to the rifle. Alternatively, certain of the invention components can be integrated into a new rifle as it is manufactured, e.g., the upper receiver coupler integral with the upper receiver and/or the barrel coupler integral with the barrel.

The components of the invention generally comprise: an upper receiver coupler for attaching to an upper receiver of an existing rifle and a barrel coupler for attaching to a barrel of the existing rifle. The upper receiver coupler and the barrel coupler are removably joined or latched together using components attached to the upper receiver coupler, to the barrel coupler, and/or to both. Further, the invention comprises a novel gas tube that is attached to the barrel, passes through the upper receiver coupler and the barrel coupler, and via a gas tube extension attaches to the rifle upper receiver.

Figure 5:
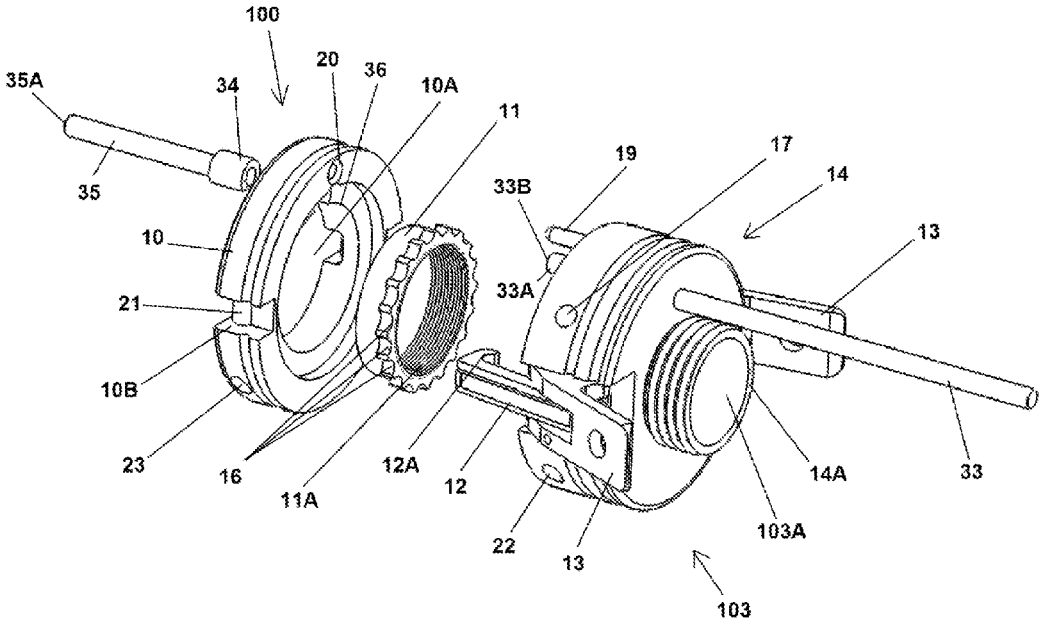
FIG. 5 illustrates an exploded view of components of a upper receiver coupler and a barrel coupler.

FIG. 5 is an exploded view illustrating an upper receiver coupler 100 and a barrel coupler 103 and their associated components. With the upper receiver coupler attached to the upper receiver, as described elsewhere herein, and the barrel coupler attached to the barrel, as described elsewhere herein, coupling the upper receiver coupler and the barrel coupler thereby attaches the barrel to the upper receiver to form a continuous path for the ammunition round.

Additionally, when the upper receiver coupler and the barrel coupler are joined, a gas tube running parallel to the barrel extends from a forward end of the barrel, passes through both couplers, and is received within the upper receiver of the rifle. Gas flowing through this path actuates various rifle functions as described above.

Figure 6:
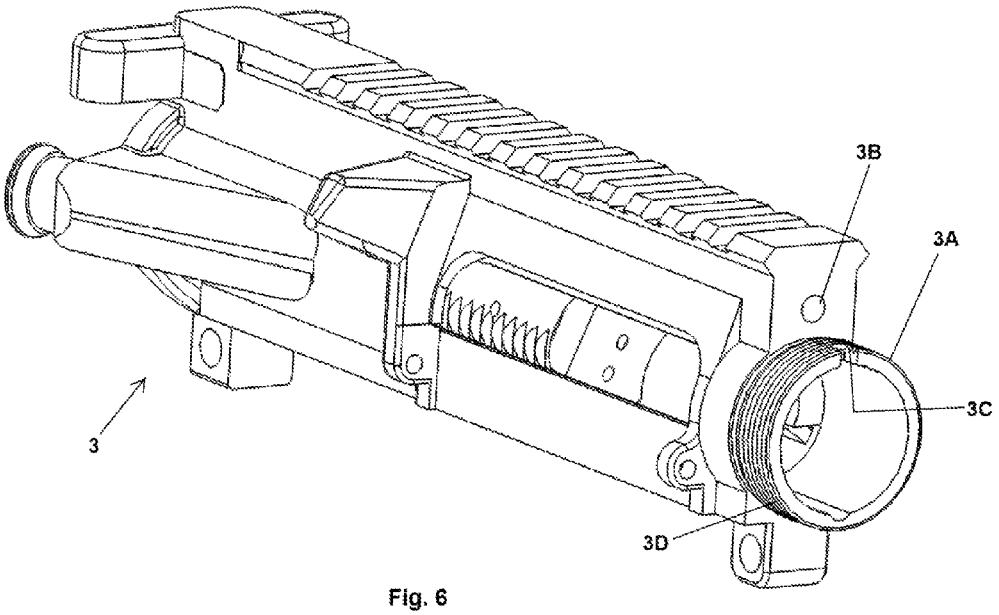
FIG. 6 illustrates the upper receiver and FIG. 7 the upper receiver with the upper receiver coupler attached thereto.

Turing to FIG. 6, it illustrates the conventional upper receiver 3 further comprising a threaded upper receiver extension 3A and a gas port 3B. In a prior art rifle, the barrel is received within the upper receiver extension 3A and a barrel nut (not shown) holds the barrel within the upper receiver extension. A groove 3C receives a tab on the barrel (not shown) to properly align the barrel to the upper receiver.

Figure 7:
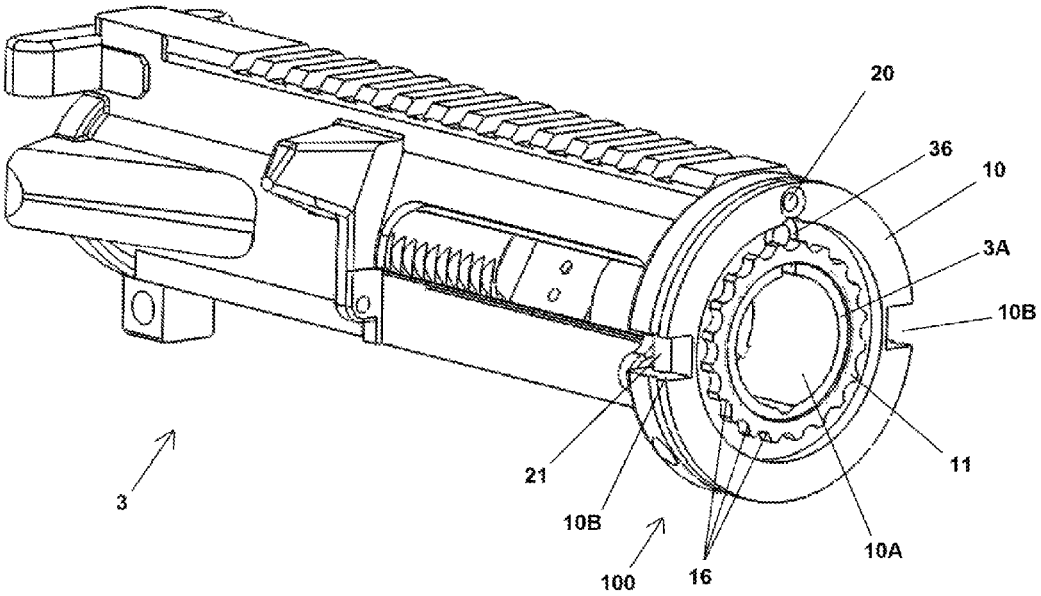

With reference to FIGS. 5, 6, and 7, to attach the upper receiver coupler 100 to the upper receiver 3, the threaded upper receiver extension 3A is inserted into an opening 10A defined in an upper receiver plate 10. Internal threads 11A of a star nut 11 threadably engage external threads of the upper receiver extension 3A, and the star nut 11 is tightened to fixedly join the upper receiver coupler 100 to the upper receiver 3. FIG. 7 illustrates the final configuration.

Semicircular grooves 16 in an outer circumference of the star nut 11 receive mating protrusions of a tool (not shown) for tightening the star nut 11. However, this feature is not a required element of the invention instead it is merely a convenient technique for tightening the star nut 11.

Figure 8:
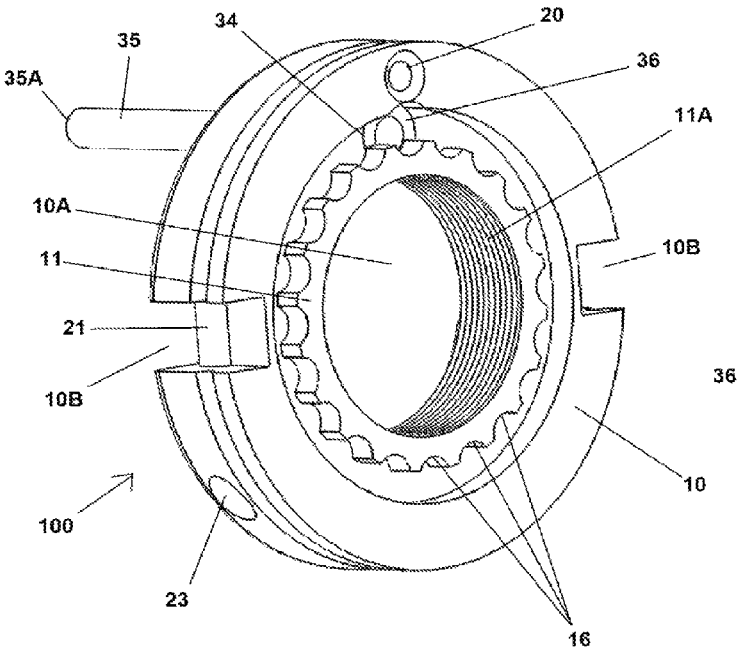
FIG. 8 illustrates the upper receiver coupler.

FIG. 8 also illustrates certain components and features of the upper receiver coupler 100 including the upper receiver plate 10 and the star nut 11. The remainder of the illustrated components are described below.

Figure 24:
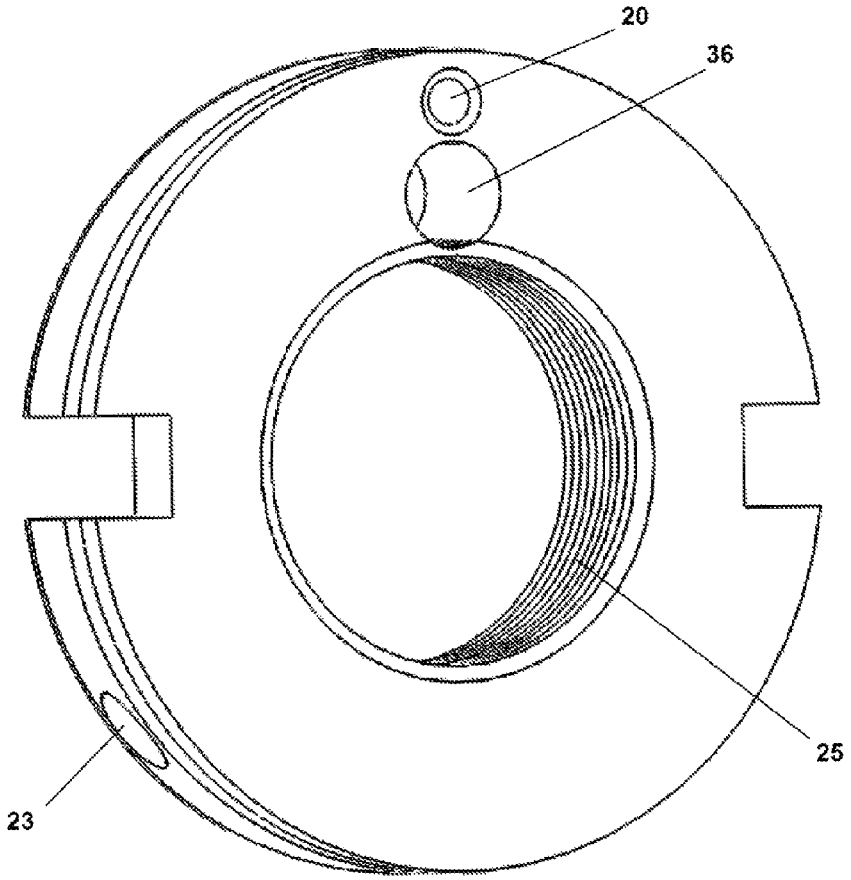
FIG. 24 illustrates an alternative embodiment of the upper receiver coupler.

In an alternative embodiment, in lieu of using the star nut 11, the upper receiver plate 10 comprises internal threads 25 (see FIG. 24) that threadably engage mating threads 3D on the upper receiver extension 3A of FIG. 6.

Figure 9:
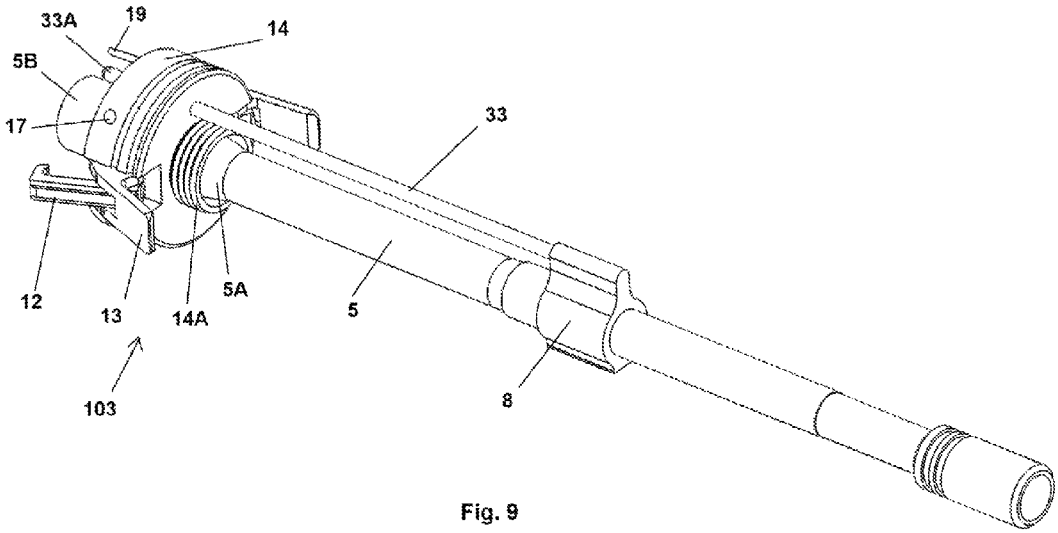
FIG. 9 illustrates the barrel coupler and the attached barrel.

With reference to FIGS. 5 and 9, to position the barrel 5 within the barrel coupler 103, the barrel is received within an opening 103A that extends through the barrel coupler. A raised segment of the barrel, referred to as a collar (see a collar 5A in FIGS. 9, 11, and 12), is disposed within the opening 103A and a rear surface of the collar 5A abuts an internal surface of the barrel coupler 103.

With continued reference to FIGS. 5 and 9, set screws 17 distributed around a circumference of a barrel plate 14 are urged against the barrel 5 to hold the barrel within the barrel coupler 103. In one embodiment the set screws are spaced at 120 degrees although only one set screw 17 is illustrated in FIG. 5. Additionally, when the barrel coupler and the upper receiver coupler are mated, the barrel flange is captured and held in place between the mated barrel coupler and the upper receiver coupler. Also, in one embodiment the groove 3C of the upper receiver extension 3A of FIG. 6 receives a tab (not shown) of the barrel to align the barrel in the upper receiver. Finally, the mated couplers exert additional forces on the barrel to secure the barrel within the barrel coupler.

As can be seen in FIG. 9, a barrel segment 5B of the barrel 5 extends beyond a rear surface of the barrel coupler 103. The barrel segment 5B extends into the opening 10A (see FIGS. 5, 7, and 8) of the coupler plate 10 when the upper receiver coupler and the barrel coupler are mated.

In lieu of using the set screws 17, the barrel can be held in place within the barrel coupler 103 by a compression fitting comprising a slot defined in the barrel plate 14 and a tension screw to close the slot after the barrel is inserted. Alternatively, an end of the barrel comprises a split cone feature with an outside-threaded nut for threading into mating threads extending from a rear surface of the barrel plate.

Returning to FIG. 5, in addition to the barrel plate 14, the barrel coupler 103 further comprises hooks 12, levers 13 for operating the hooks 12, and a barrel plate extension 14A. Only one hook 12 and lever 13 is illustrated in FIG. 5 as the opposing hook and lever is not visible in FIG. 5.

Figure 22:
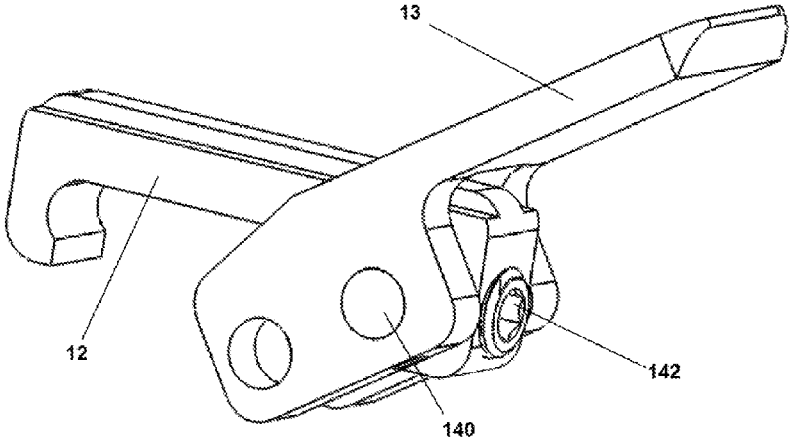
FIGS. 22 and 23 illustrate different views of details of the hook and lever of the barrel coupler.
Figure 23:
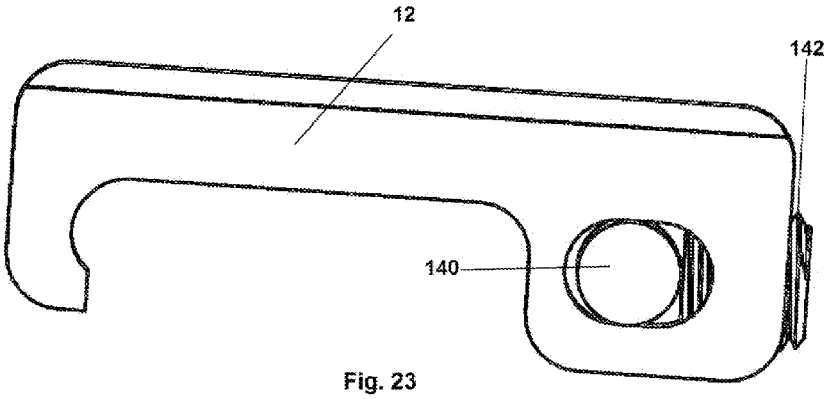

The hooks 12 and levers 13 are held together by pins not illustrated in FIG. 5 but depicted as a pin 140 in FIGS. 22 and 23. With reference to FIG. 5, the pin is held in position by a set screw 22, again, with only one illustrated in FIG. 5.

With the barrel coupler 103 in contact with the upper receiver coupler 100, exerting an inwardly-directed force on the levers 13 forces the hooks 12 to each engage a hardened pin 21 within each recess 10B in the upper receiver plate 10. This action locks the barrel plate 14 to the receiver plate 10 and thereby locks the barrel coupler 103 to the upper receiver coupler 100. Another hook, lever, recess and pin are disposed on an opposing side of the respective barrel plate and the upper receiver plate and thus are hidden from view in FIG. 5.

The illustrated pin 21 is held in position by action of a set screw 23.

With the barrel 5 attached to the barrel coupler 103 with the set screws 17, the barrel coupler 103 attached to the upper receiver coupler 100 with the hooks 12, and the upper receiver coupler attached to the upper receiver 3 with the star nut 11, the barrel is thereby coupled to upper receiver to provide a path for the round as it exits the upper receiver, enters and passes through the barrel segment 5B (see FIG. 9) and the barrel 5, and exits from a forward end of the barrel 5.

With this invention the barrel 5 can be easily and quickly changed by operating the levers 13 to release the hooks 12 and thereby separate the upper receiver coupler 100 from the barrel coupler 103 and loosening the set screws 17. This operation is much simpler than the required operations to remove the barrel in a prior art rifle.

With reference to FIG. 5, when the barrel coupler 103 is brought into contact with the upper receiver coupler 100, an alignment pin 19 extending rearward from a rear surface of the barrel plate 14 is received within an opening 20 in a front surface of the upper receiver plate 10 for aligning the upper receiver coupler 100 and the barrel coupler 103.

Figure 10:
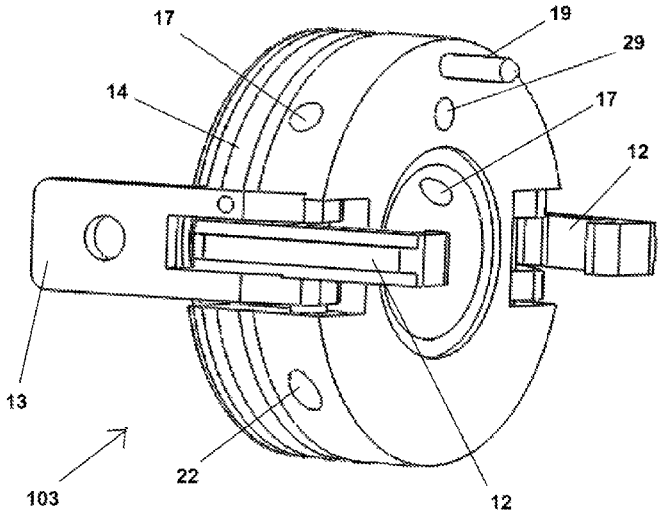
FIG. 10 illustrates the barrel coupler.

FIG. 10 is a rear view of the barrel coupler 103. In particular, this view shows an opening 29 through which a primary gas tube 33 passes, as described below.

As described above, a gas-operated rifle uses some of the high pressure gas generated as the ammunition round travels through the barrel to supply energy to operate the auto-loading feature of the rifle. In the present invention, a high pressure gas path extends from an entry point of the gas tube on the barrel 5, along the barrel, through the barrel coupler 103, through the upper receiver coupler 100 and finally to the upper receiver 3.

As can be seen in FIGS. 5 and 9, a primary gas tube 33 extends forward from the barrel plate 14 runs parallel to the barrel 5 and connects to the barrel 5 at the gas block 8.

Working toward the butt stock of the rifle and beginning at the barrel plate 14, the primary gas tube 33 passes through the opening 29 (see FIG. 10) in the barrel plate 14. A rearward segment 33A of the primary gas tube 33 (see FIGS. 5 and 9) extends rearward out from the opening 29 in the barrel plate and through an opening 36 (see FIG. 8) in the receiver plate 10. An end 33B of the rearward segment 33A mates with a coupler 34 (that is, when the upper receiver coupler 100 and the barrel coupler 103 are coupled) that is in turn connected to a gas tube extension 35 (see FIGS. 5 and 8).

To avoid interference between the rearward segment 33A of the primary gas tube 33 and the upper receiver coupler 100 and its associated components, the rearward segment 33A is disposed within one of the semicircular grooves 16 of the star nut 11.

An end 35A of the gas tube extension 35 (both of which are depicted in FIG. 5) is received within the gas port 3B of the upper receiver 3 as illustrated in FIG. 6.

Figure 11:
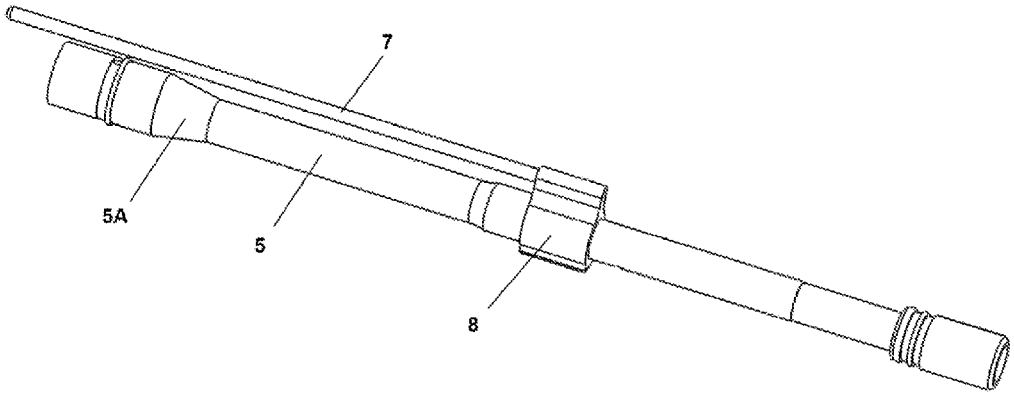
FIGS. 11 and 12 illustrate the barrel with different length gas tubes.

FIG. 11 illustrates the barrel 5 with a stock or stock gas tube 7 installed in the gas block 8.

Figure 12:
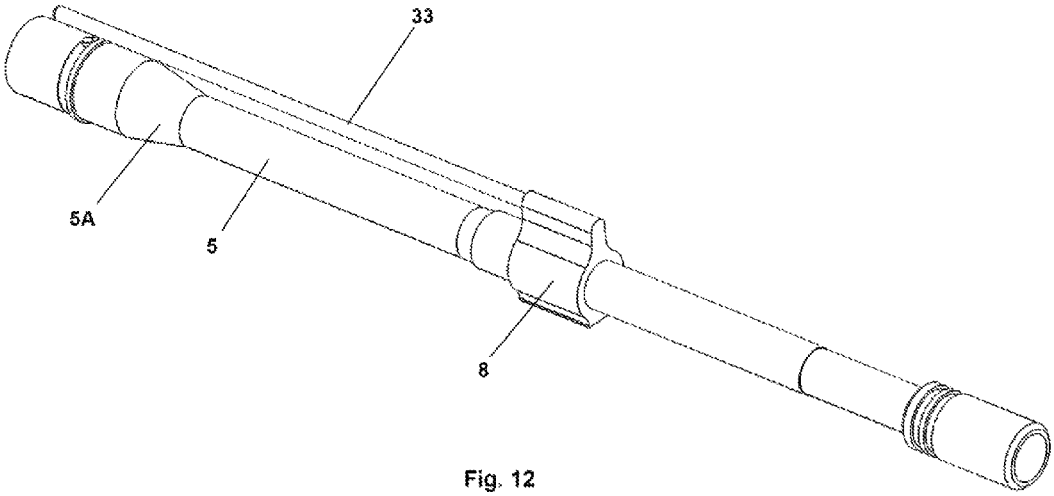

FIG. 12 illustrates the barrel 5 with the shortened primary gas tube 33, i.e., shorter than the stock gas tube 7, installed in the gas block 8. The shortened gas tube is required due to presence of the receiver coupler 100 and the barrel coupler 103 in the gas flow path between the gas block 8 and the gas port 3B in the upper receiver 3.

Figure 13:
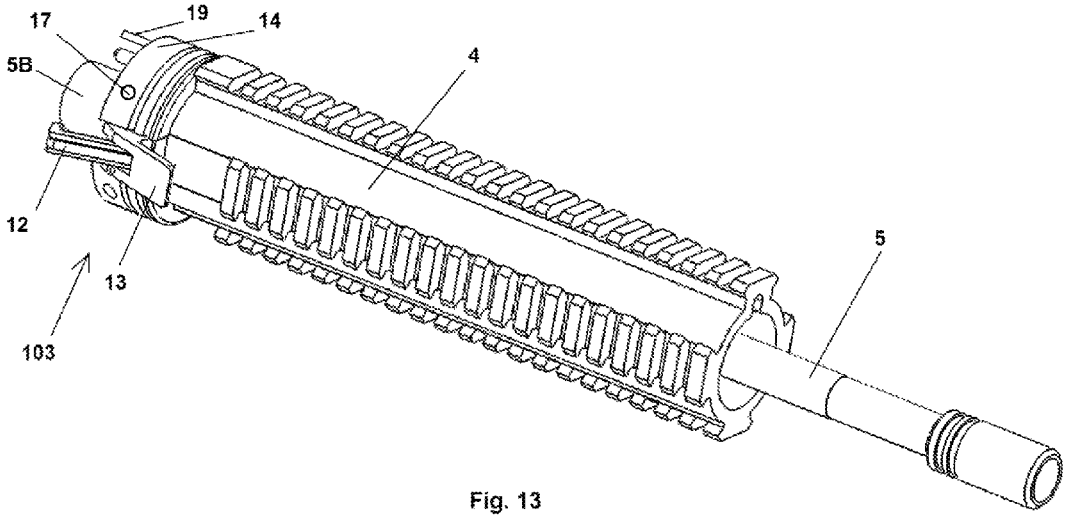
FIG. 13 illustrates the barrel coupler, the barrel, and the hand guard.

FIG. 13 illustrates the hand guard 4 as mated with the barrel coupler 103 and covering a segment of the barrel 5 and the entire length of the primary gas tube 33. To attach the hand guard 4, inside threads of the hand guard threadably engage outside matching threads of the barrel plate extension 14A depicted at least in FIGS. 5 and 9.

FIG. 13 also reveals that the hand guard 4 and the barrel 5, when affixed to the barrel coupler 103, can be removed from the rifle as a unitary structure by simply separating the barrel coupler 103 from the upper receiver coupler 100.

Figure 14:
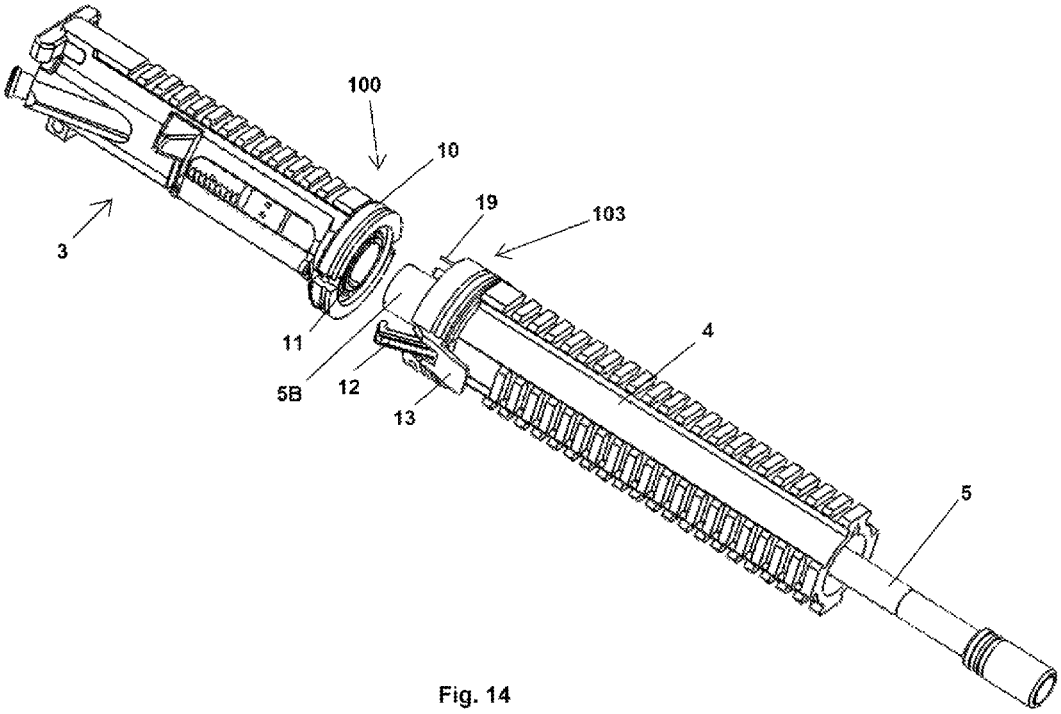
FIG. 14 illustrates an exploded view of the upper receiver coupler (attached to the upper receiver) and the barrel coupler (attached to the barrel and hand guard).

FIG. 14 illustrates the upper receiver coupler 100 (and certain ones of its attached components) in position to mate with the barrel coupler 103 (and certain ones of its attached components).

To mate the upper receiver coupler 100 and the barrel coupler 103, (see FIGS. 5 and 14 in particular) the opening 10A in the upper receiver plate 10 is aligned with the barrel segment 5B, the pin 19 of the barrel coupler is aligned with the opening 20 in the receiver coupler, and the rearward segment 33A of the gas tube is aligned with the coupler 34. The upper receiver coupler and the barrel coupler are brought into contact and by the application of an inwardly directed force on the levers 13, the hooks 12 on the barrel coupler are locked around the pins 21 in the recesses 10B of the upper receiver coupler.

Figure 15:
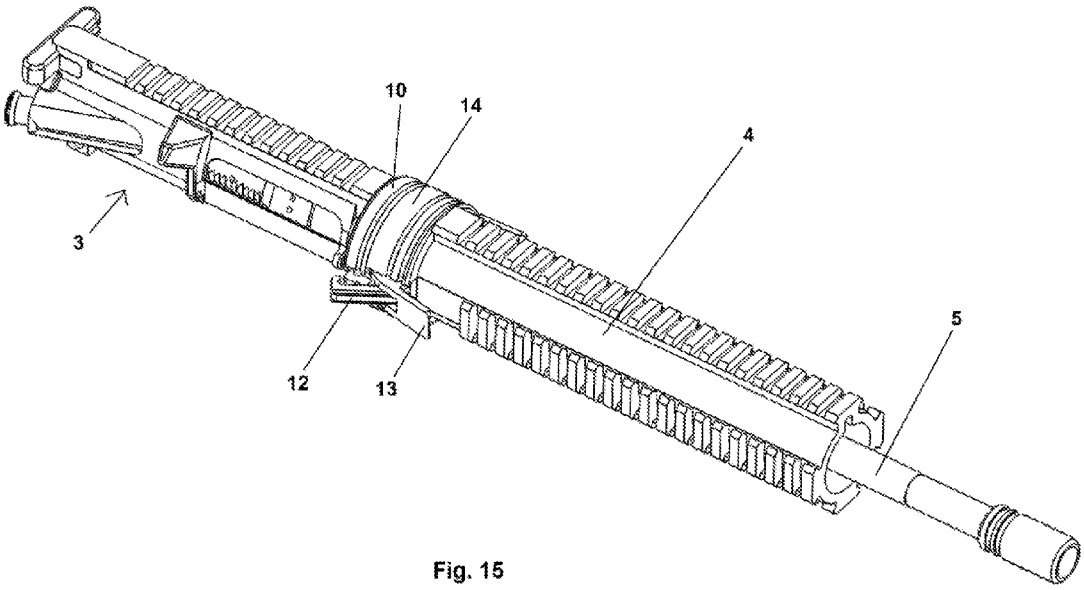
FIG. 15 illustrates the barrel coupler mated to the upper receiver coupler.

FIG. 15 illustrates the mated upper receiver coupler 100 and the barrel coupler 103 with the hooks 12 in an open position.

Figure 16:
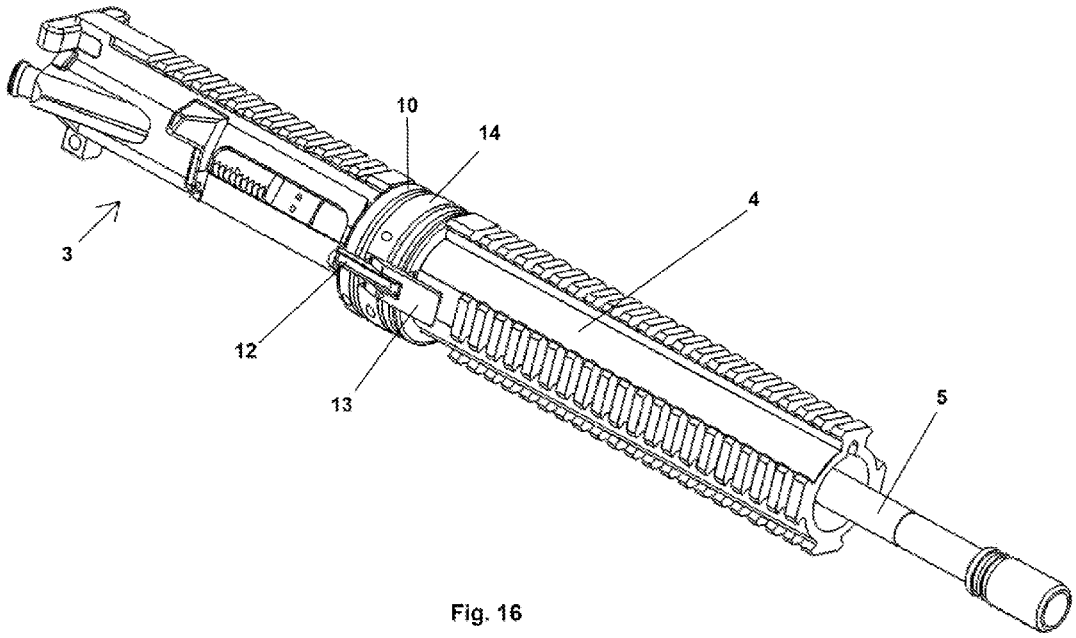
FIG. 16 illustrates the barrel coupler attached to the upper receiver coupler.

FIG. 16 illustrates the coupled upper receiver coupler 100 and the barrel coupler 103 with the hooks 12 in a closed position.

Figure 17:
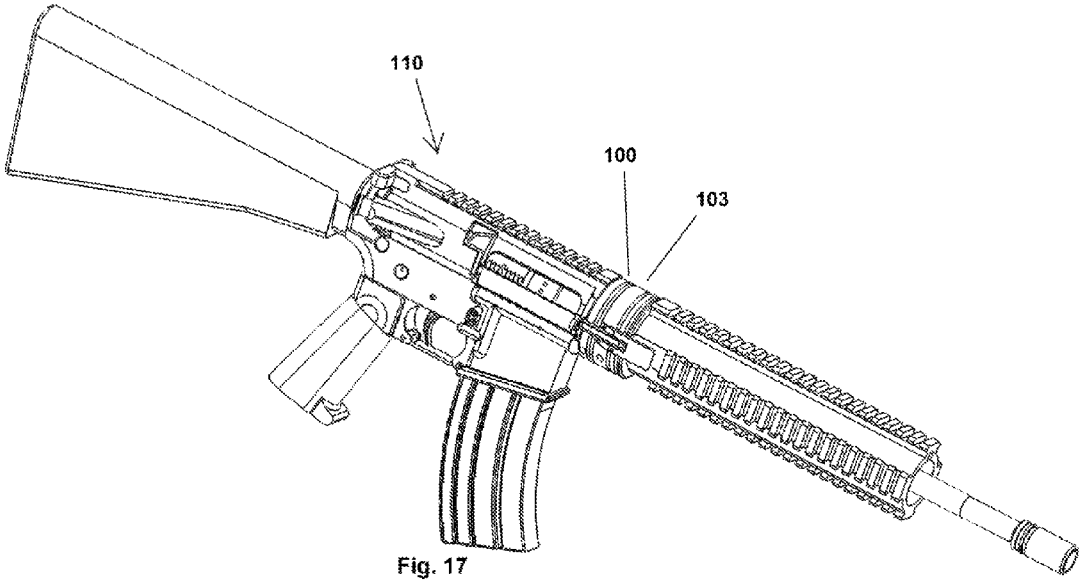
FIG. 17 illustrates an AR15/AR10 rifle with the components of the present invention attached thereto.

FIG. 17 illustrates an AR15/AR10 110 depicting the upper receiver coupler 100 and the barrel coupler 103 of the present invention.

Figure 18:
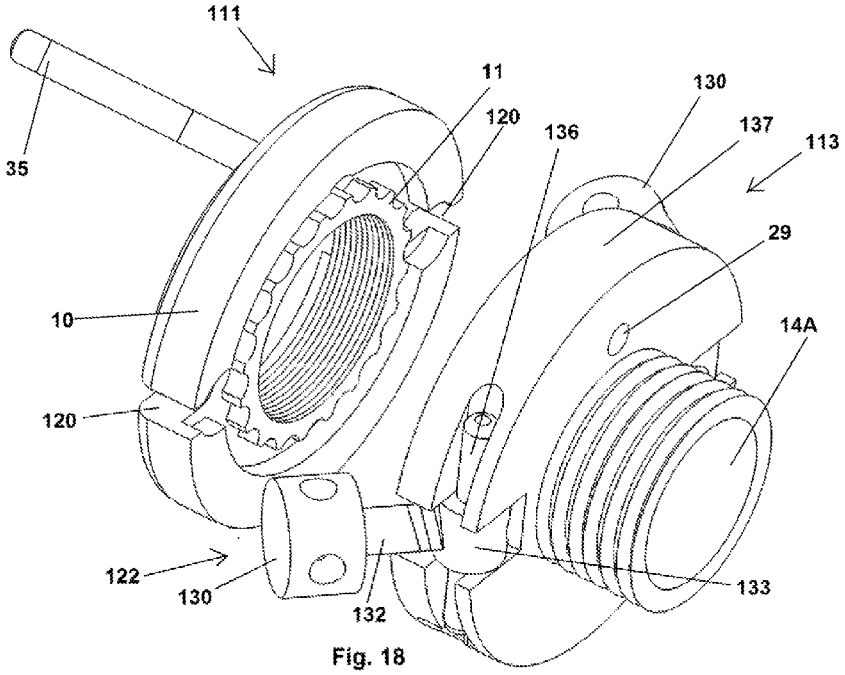
FIG. 18 illustrates another embodiment of the barrel coupler and upper receiver coupler.

FIG. 18 illustrates another embodiment of the present invention comprising an upper receiver coupler 111 for mating with a barrel coupler 113. The upper receiver coupler 111 defines recesses 120 each for receiving a hook 122 (in lieu of the hook 12 of other embodiments) to attach the upper receiver coupler 111 to the barrel coupler 113.

Each hook 122 comprises a head 130 affixed to a shaft 132 at a first end thereof. A second end of the shaft 132 terminates in a ring 133 concentrically mounted on a pin 136 that is in turn attached to or captured within a barrel plate 137. The hooks 122 are pivoted into the recesses 120 to lock the upper receiver coupler 111 and the barrel coupler 113 together.

Pivoting of the hooks 122 out of the recesses 120 permits separation of the upper receiver coupler 111 and the barrel coupler 113. Only one of the hooks 122 is depicted in its entirety in FIG. 18, another hook 122 and its associated components is hidden from view in FIG. 18.

In one embodiment the head 130 threadably engages mating threads (not shown) on the shaft 132. The coupling force exerted by the hook 122 on the upper receiver coupler 111 is adjusted by turning the head 130 on the mating threads of the shaft 132.

Figure 19:
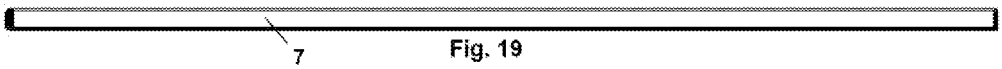
FIGS. 19-21 illustrate three different gas tubes.
Figure 20:
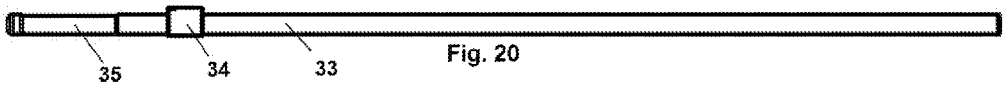
Figure 21:
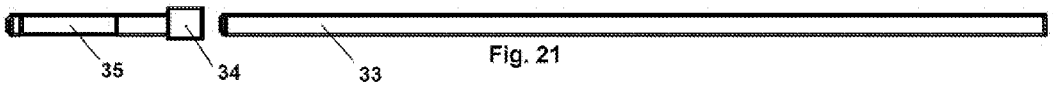

FIG. 19 illustrates a stock gas tube 7. FIG. 20 illustrates the shortened primary gas tube 33 connected to the gas tube extension 35 for use with the couplers of the present invention. FIG. 21 illustrates an exploded view of the primary gas tube 33 and the gas tube extension 35.

FIG. 22 is a close-up view of the hook 12 and the lever 13 including a pivot pin 140 and a tension adjustment screw 142. Turning the screw 142 adjusts (increasing or decreasing) the force exerted by the hook 12 for holding the upper receiver coupler 100 and the barrel coupler 103 together and for increasing or decreasing the distance between the two couplers.

FIG. 23 depicts the hook 12, the pivot pin 140 and the tension adjustment screw 142.

Because the components of the present invention can be added to an existing rifle without modifying the existing rifle, these components can be easily removed and the rifle returned to its original configuration whenever desired. This is an advantage to the rifle owner who may wish to sell or trade-in a rifle that has been modified to implement the features of the present invention.

While the invention has been described with reference to various embodiments, it will be understood by those skilled in the art that various changes may be made and equivalent elements and process steps may be substituted for elements and steps thereof without departing from the scope of the present invention. The scope of the present invention further includes any combination of the elements and process steps from the various embodiments set forth herein. In addition, modifications may be made to adapt a particular situation to the teachings of the present invention without departing from its essential scope. Therefore, it is intended that the invention not be limited to the particular embodiment disclosed as the best mode contemplated for carrying out this invention, but that the invention will include all embodiments falling within the scope of the appended claims.

What is claimed is:

1. A kit for use with a modular weapon having a barrel and having an upper receiver defining a gas port and a barrel opening, the kit comprising:

an upper receiver plate for attaching to the upper receiver;

a barrel plate defining a first opening therethrough;

the barrel for passing through second and third concentric openings defined in the respective upper receiver plate and the barrel plate, the barrel for connecting to the barrel opening;

a primary gas tube;

a gas tube extension;

the first opening of the barrel plate for receiving the primary gas tube such that a rearward segment of the primary gas tube extends rearwardly from the first opening and a forward segment of the primary gas tube extends forwardly from the first opening;

a forward end of the gas tube extension for coupling to a rearward end of the primary gas tube and a rearward end of the gas tube extension received within the gas port when the kit is in use with the modular rifle;

an assembly for removably attaching the upper receiver plate and the barrel plate thereby creating a gas flow path beginning at the gas port and comprising the gas tube extension, the rearward segment of the primary gas tube, and the forward segment of the primary gas tube; and the second concentric opening in the upper receiver plate for receiving a threaded upper receiver extension of the upper receiver, and wherein the kit further comprises a threaded component for threadably engaging the threaded upper receiver extension for attaching the upper receiver plate to the upper receiver.

2. The kit of claim 1 wherein the modular weapon comprises a modular rifle.

3. The kit of claim 1 wherein the barrel is held within the second and third concentric openings in the upper receiver plate and the barrel plate by a plurality of threaded members threadably engaged in the barrel plate and urged against the barrel.

4. The kit of claim 1 wherein the threaded component comprises a star nut having internal threads for threadably engaging external threads of the threaded upper receiver extension the star nut defining a circumferential shape for receiving a tool for tightening the star nut.

5. The kit of claim 1 wherein the second concentric opening in the upper receiver plate defines internal threads for threadably engaging external threads of the upper receiver extension of the upper receiver for attaching the upper receiver plate to the upper receiver.

6. The kit of claim 1 wherein the assembly for removably attaching the upper receiver plate and the barrel plate comprises one or more latches disposed on one of the upper receiver plate and the barrel plate for capturing one or more respective capture devices disposed on an other of the upper receiver plate and the barrel plate.

7. The kit of claim 6 wherein the one or more latches comprise a total of a first hook and a second hook spaced apart at 180 degrees along a circumference of the barrel plate, and wherein the one or more capture devices comprise a total of a first in and a second pin spaced apart at 180 degrees along a circumference of the upper receiver plate, the first and second pins for capturing respective first and second hooks.

8. The kit of claim 6 wherein the one or more latches each comprise a hook operated by a lever, and the one or more capture devices each comprise a pin, and wherein application of a force on the lever moves the hook to removably capture the pin thereby holding the upper receiver plate and the barrel plate in a contact relationship.

9. The kit of claim 6 wherein the one or more latches comprise a total of a first latch and a second latch each disposed on a circumference of the barrel plate, and the one or more capture devices comprise a total of a first pin and a second pins disposed in respective first and second recesses on a circumference of the upper receiver plate.

10. The kit of claim 1 wherein the assembly for removably attaching the upper receiver plate and the barrel plate comprises:

first and second pins attached to the barrel plate;

first and second shafts each having a first end attached to and rotatable about respective first and second pins; and first and second heads attached to a second end of respective first and second shafts; and the first and second shafts captured within respective first and second recesses of the upper receiver plate and held within the respective first and second recesses by the respective first and second heads exerting a force directed against a rear surface of the upper receiver plate.

11. The kit of claim 1 the barrel plate further comprising a threaded member extending from a front surface of the barrel plate for threadably engaging a hand guard such that the hand guard surrounds at least a segment of the barrel.

12. The kit of claim 1 wherein one of the upper receiver plate and the barrel plate comprises an alignment pin for engaging an alignment opening in an other of the upper receiver plate and the barrel plate when the upper receiver plate is attached to the barrel plate.

13. The kit of claim 1 further comprising a plurality of barrels of differing lengths, a forward end of the primary gas tube for attaching to the barrel with a gas block.

14. The kit of claim 1 wherein the barrel comprises a forward barrel segment separated from a rearward barrel segment by a collar, the forward barrel segment longer than the rearward barrel segment, wherein the barrel passes through the second concentric opening in the upper receiver plate concentrically oriented with the third concentric opening in the barrel plate, the barrel secured within the second concentric opening.

15. The kit of claim 1 wherein the upper receiver plate defines a fourth opening therein, the rearward segment of the primary gas tube passing through the fourth opening for connecting to the gas port defined in the upper receiver, the kit further comprising a coupler for coupling the forward end of the gas tube extension to the rearward end of the primary gas tube proximate the fourth opening.

16. A system for connecting a barrel to an upper receiver of a modular rifle, the upper receiver comprising a threaded upper receiver extension, the system comprising:

an upper receiver plate defining a first opening therethrough, the threaded upper receiver extension for receiving within the first opening;

a threaded component for threadably engaging the threaded upper receiver extension for removably attaching the upper receiver plate to the upper receiver;

the upper receiver plate further defining a second opening therethrough;

a barrel plate defining a third opening therethrough;

a primary gas tube segment for attaching to a forward segment of the barrel, for extending rearwardly along the barrel, and for passing through the third opening of the barrel plate;

a gas tube extension coupled to the upper receiver plate and connected between a rearward end of the primary gas tube and a gas port defined in the upper receiver to form a gas path from the forward segment of the barrel, through the barrel plate and the upper receiver plate to the gas port;

the barrel for passing through the second opening of the upper receiver plate and the third opening of the barrel plate, for attaching to the barrel plate and for receiving within the upper receiver; and a component for removably attaching the upper receiver plate and the barrel plate.

17. The system of claim 16 wherein the barrel is held within the third opening of the barrel plate by a plurality of threaded members threadably engaged in the barrel plate and urged against the barrel.

18. The system of claim 16 wherein the component for removably attaching the upper receiver plate and the barrel plate comprises one or more latches disposed on one of the upper receiver plate and the barrel plate for capturing one or more respective pins disposed on an other of the upper receiver plate and the barrel plate.

19. A weapon comprising:

an upper receiver defining a gas port and a barrel opening, the upper receiver comprising a threaded upper receiver extension;

a barrel;

an upper receiver plate defining a first opening therethrough, the upper receiver extension received within the first opening;

a threaded component for threadably engaging the upper receiver extension to attach the upper receiver plate to the upper receiver;

a barrel plate attached to the barrel, the barrel plate defining second and third openings therethrough;

a primary gas tube;

a gas tube extension;

the second opening of the barrel plate receiving the primary gas tube such that a rearward segment of the primary gas tube extends rearwardly from the second opening and a forward segment of the primary gas tube extends forwardly from the second opening;

a forward end of the gas tube extension coupled to a rearward end of the primary gas tube proximate the first opening in the upper receiver plate and a rearward end of the gas tube extension received within the gas port; and an assembly removably attaching the upper receiver plate and the barrel plate thereby creating a gas flow path beginning at the gas port and comprising the gas tube extension, the rearward segment of the primary gas tube, and the forward segment of the primary gas tube, the assembly further securing the barrel to the barrel plate within the third opening of the barrel plate.

* * * * *